US007624563B2

(12) United States Patent
Winter

(10) Patent No.: US 7,624,563 B2
(45) Date of Patent: Dec. 1, 2009

(54) TOP ROLLER CARRIER FOR DRAFTING SYSTEMS IN SPINNING MACHINES

(75) Inventor: Josef Winter, Winterbach (DE)

(73) Assignee: Accotex-Texparts GmbH, Fellbach (DE)

( * ) Notice: Subject to any disclaimer, the term of this patent is extended or adjusted under 35 U.S.C. 154(b) by 167 days.

(21) Appl. No.: 11/883,620

(22) PCT Filed: Nov. 9, 2005

(86) PCT No.: PCT/EP2005/011964

§ 371 (c)(1),
(2), (4) Date: Aug. 2, 2007

(87) PCT Pub. No.: WO2006/081852

PCT Pub. Date: Aug. 10, 2006

(65) Prior Publication Data

US 2008/0040894 A1 Feb. 21, 2008

(30) Foreign Application Priority Data

Feb. 5, 2005 (DE) ..... 10 2005 005 382

(51) Int. Cl.
*D01H 5/46* (2006.01)

(52) U.S. Cl. ..... 57/315; 19/244; 19/266; 19/271; 19/295

(58) Field of Classification Search ..... 57/315; 19/244, 266, 271, 295
See application file for complete search history.

(56) References Cited

U.S. PATENT DOCUMENTS

| | | | | |
|---|---|---|---|---|
| 3,080,618 | A | 3/1963 | Schiltknecht | 19/267 |
| 3,256,570 | A | 6/1966 | Kalno | 19/295 |
| 3,283,367 | A * | 11/1966 | Pierannunzi et al. | 19/278 |
| 4,398,320 | A * | 8/1983 | Kubota et al. | 19/236 |
| 4,538,329 | A | 9/1985 | Sakai et al. | 19/244 |

FOREIGN PATENT DOCUMENTS

| | | |
|---|---|---|
| CH | 656 647 A5 | 7/1986 |
| DE | 1 131 571 | 6/1962 |
| DE | 1 990 776 | 7/1967 |
| DE | 39 37 667 A1 | 5/1991 |
| DE | 92 14 598.1 | 1/1993 |
| DE | 43 35 889 A1 | 4/1995 |
| DE | 199 19 410 A1 | 11/1999 |
| DE | 103 21 893 A1 | 12/2004 |
| GB | 691615 | 5/1953 |
| GB | 817206 | 7/1959 |

* cited by examiner

*Primary Examiner*—Shaun R Hurley
(74) *Attorney, Agent, or Firm*—K&L Gates LLP

(57) ABSTRACT

A top roller carrier for drafting systems in spinning machines with at least one pair of feed rollers, one pair of apron rollers and one pair of output rollers as top rollers and with holding devices for the top rollers, and wherein the top rollers are rotatably mounted on the ends of axles which are held centrally between the top rollers. According to the present invention, a common holding device is provided for the axle of the output rollers and the axle of the apron rollers and is movably connected to the top roller carrier and fixes the two axles at a rigid spacing with respect to one another.

8 Claims, 5 Drawing Sheets

TOP ROLLER CARRIER FOR DRAFTING SYSTEMS IN SPINNING MACHINES

CROSS-REFERENCE TO RELATED APPLICATIONS

This application claims the benefit of German patent application 10 2005 005 382.3, filed Feb. 5, 2005, herein incorporated by reference.

FIELD OF THE INVENTION

The invention relates to a top roller carrier for drafting systems in spinning machines and, more particularly, to a top roller carrier with at least one pair of feed rollers, one pair of apron rollers and one pair of output rollers as top rollers and with holding devices for the top rollers, wherein the top rollers are rotatably mounted on the ends of axles which are held centrally between the top rollers.

BACKGROUND OF THE INVENTION

Top roller carriers are generally used as a carrying and loading arm for pairs of top rollers and can be lifted relative to the bottom rollers mounted so as to be secured to the machine.

In drafting systems, it is known to carry out an adaptation, which is necessary for reasons concerning textile technology, to the fibre material or the staple length of the fibre material and, for this purpose, to change the spacing between the clamping lines formed by the pairs of rollers of the drafting system. This spacing is also called the field width. It is known, for this purpose, to configure the top roller carrier for the field width adjustment in such a way that the spacings between the top rollers can be adjusted. German Patent Publication DE 43 35 889 C2, for example, shows a top roller carrier for drafting systems of spinning machines, in which the top rollers are mounted in holders by slides. The slides can be adjusted separately from one another for the field width adjustment, in each case, in the longitudinal direction of the top roller carrier. A holder for top aprons is associated with the apron roller. Configured in the top roller carrier is an elastic hollow body, which is loaded with pressure, pneumatically or alternatively hydraulically. The pressure acts via a base plate of the hollow body on plungers and loads the feed and the output roller and also the apron roller and the holder for the top apron with a force, which presses against the bottom rollers and allows the top rollers to act as pressure rollers.

The German Utility Model G 92 14 598 U1 describes a top apron holder for spinning machine drafting systems with an apron guide, which deflects the top apron and tensions it under the pressure of a spring. The apron guide is held on a central piece of the top apron holder.

A load carrier for drafting systems of spinning machines is known from the generic German Patent Publication DE 39 37 667 A1, in which the axles of the top rollers are each fastened in holders, which can be displaced independently of one another in longitudinal guides of the top roller carrier for the field width adjustment. The drafting system is a three roller drafting system, in which the top rollers are configured as pressure roller twins. The pressure on the top rollers is applied by the holders acting like a spring element because of their shape. The holders are not set up to vary the pressure force.

The holders of the known top roller carriers, as they are described in the above-mentioned documents, have the common drawback that they require a large number of individual parts and require time-consuming field width adjustments that are prone to faults for the apron and output roller.

Swiss Patent Publication CH 656 647 A5 shows an apron drafting system, which is used in a spinning machine and has three pairs of rollers consting, in each case, of top and bottom rollers. The top rollers are held in the top roller carrier, which is arranged so as to be pivotable about a pivot pin with respect to the machine stand.

The box-shaped top roller carrier contains a guide arrangement for the top roller pins. Holding down devices, which are spring-loaded in their longitudinal central region and with which approximately the same gap contact pressure is to be achieved for all the pairs of rollers, engage thereon. The top roller carrying pins are guided for this purpose in guide slots of the top roller carrier. The play always occurring in this case between the top rollers and guide edges counteracts an exact adjustment of the clamping point and leads to wear problems. The spacing of the top rollers from one another in the longitudinal direction of the top roller carrier cannot be changed for this reason. An adjustment of the field widths, such as is necessary during adaptation to the fibre material to be respectively processed, is not possible.

Both British Patent Publication GB 691615 and U.S. Pat. No. 3,256,570 show three-roller drafting systems for spinning machines, in which the top roller carrier has slots which are spaced apart from one another in the longitudinal direction of the top roller carrier for guiding the top roller carrying pins or the axles of top rollers.

It can be inferred from British Patent Publication GB 691615 that, to change the spacing of the top rollers guided by the top roller carrier, the top roller carrier present has to be replaced by a top roller carrier, in which the arrangement or the spacing of the slots differs according to the changed requirements. For a fibre material change mentioned as an example, of cotton to viscose, it is described as sufficient to hold two or three alternatively usable or replaceable top roller carriers in readiness. A replacement of this type of the top roller carrier including disassembly and installation of the top rollers is very laborious.

In the drafting system of U.S. Pat. No. 3,256,570, all three top rollers are carried respectively at their axle ends by a frame-like top roller carrier. The guides of the top roller carrying pins are also affected by play as in the apron drafting system of Swiss Patent Publication CH 656 647 A5 and particularly prone to wear because of the top roller carrier pins co-rotating with the top roller. U.S. Pat. No. 3,256,570 describes how the pivoting up of the top roller carrier can be facilitated in magnetically held top rollers and gives absolutely no indication as to how the spacings apart of the top rollers could be changed. This is also only possible by means of a very laborious replacement of the top roller carrier in the drafting system of U.S. Pat. No. 3,256,570.

SUMMARY OF THE INVENTION

The object of the invention is to improve the known top roller carriers.

The object is achieved according to the invention by means of a top roller carrier for drafting systems in spinning machines with at least one pair of feed rollers, one pair of apron rollers and one pair of output rollers as top rollers and with holding devices for the top rollers, and wherein the top rollers are rotatably mounted on the ends of axles which are held centrally between the top rollers. According to the present invention, a common holding device is provided for the axle of the output rollers and the axle of the apron rollers and is movably connected to the top roller carrier and fixes the two axles at a rigid spacing with respect to one another.

Advantageous configurations of the top roller carrier are described more fully herein.

The holding device according to the invention movably connected to the top roller carrier combines the axle receivers for the output roller and the apron roller in one component. The position of the axle receivers in the holding device and therefore the position of the axles of the output roller and the apron roller with respect to one another can be produced with a high degree of manufacturing precision. In this manner, an extraordinarily exact positioning of the clamping points of the apron roller and output roller can be achieved and maintained. The parallelism of the output roller and apron roller is always ensured. The addition of conventional safety spacings can be dispensed with. Such conventional safety spacings are taken into account, for example, in the adjustment of the desired field width, because the achievable accuracy in the field width adjustment can only be inadequate. Manufacturing and assembly inaccuracies, which can add up with multi-part holders, allow an oblique position of the top rollers, which disadvantageously influences the adjustment of the field widths. Additions in the form of safety spacings are to counteract this. The holding device according to the invention reduces the number of components for the holding device compared to conventional holding devices. In order to be able to load the holding device with a force in the direction of the bottom rollers, only a single common mechanism, for example a spring mechanism, is necessary. The force loading of the output roller and apron roller can take place separately from other top rollers like the feed roller. The outlay occurring during a change in the significant field width adjustment between the apron roller and feed roller is small. The outlay required during production and assembly is lowered as less and only simpler parts are required.

The holding device advantageously comprises a top apron deflection device, the top apron deflection device being configured as a vane, which ends at the free end with a deflection edge. The number of components on the top roller carrier is thereby further reduced. The orientation of the top apron deflection device with respect to the apron roller is very precise and cannot disadvantageously change due to the effect of assembly tolerances or the summation of manufacturing tolerances of a plurality of components. The deflection edge cannot be deflected from the parallel orientation by poor adjustment or fibre materials which are difficult to draw. A deflection of this type would disadvantageously lead to number fluctuations or even to aprons running off axially. The degree of opening remains the same.

If the deflection edge is configured as a chromium-plated metal bar and if the metal bar is fastened to the vane, only a little friction occurs during the deflection process, and the deflection edge is only subjected to low wear. The apron slippage is minimised by the low-friction deflection edge.

Maintenance intervals can be increased. The apron roller only has to be disassembled rarely or not at all.

An apron tensioner is preferably associated with the holding device and is oriented axially parallel to the top rollers and movable relative to the holding device. This embodiment allows a simple flexible tensioning of the top aprons. An excellent apron synchronisation is ensured.

The required contact force can easily be applied with a holding device, which has a head part, and in which, by a force acting from above, a loading force can be exerted on the apron rollers and output rollers configured as a top roller, by means of the head part. If the head part is configured as a separate component which can be longitudinally displaced relative to the holding device, the division of the pressure force over the apron roller and the output roller can be changed.

Both a head part, which is configured as a pressure plate, over which an elastic hollow body is arranged, and wherein the force sufficient for generating the loading pressure can be generated, pneumatically or hydraulically, with the aid of the hollow body, and also a head part, over which a spring is arranged in the top roller carrier, by means of which spring the head part can be loaded with the force, allow a regulated loading of the output roller and the apron roller with a pressure force. With uniform pressure distribution owing to the non-interrupted pressure plate, the wear can be reduced, the service life increased and the maintenance intervals can be lengthened. To apply the loading pressure to the output roller and apron roller, only a single device is necessary for the two rollers. A common adjustable force loading of output roller and apron roller separately from other top rollers like the feed roller, is possible.

A holding device consisting of plastics material can be produced particularly economically, has only a low weight, is resistant to corrosion and satisfies the elasticity demands on the holding device. Polyoxymethylene, designated POM, is distinguished by a high degree of hardness, stiffness and toughness and is particularly suitable for this application. If the plastics material is electrically conductive, an uncomplicated discharge of electrostatic charges is ensured. Thus disturbances in the spinning operation caused by electrostatic charge are avoided.

Time-consuming field width adjustment work prone to errors for the apron and output roller is dispensed with. Only a simple adjustment for the feed roller is required.

BRIEF DESCRIPTION OF THE DRAWINGS

Further details of the invention are described below with the aid of the figures, in which.

DETAILED DESCRIPTION OF THE PREFERRED EMBODIMENTS

Figure 1:
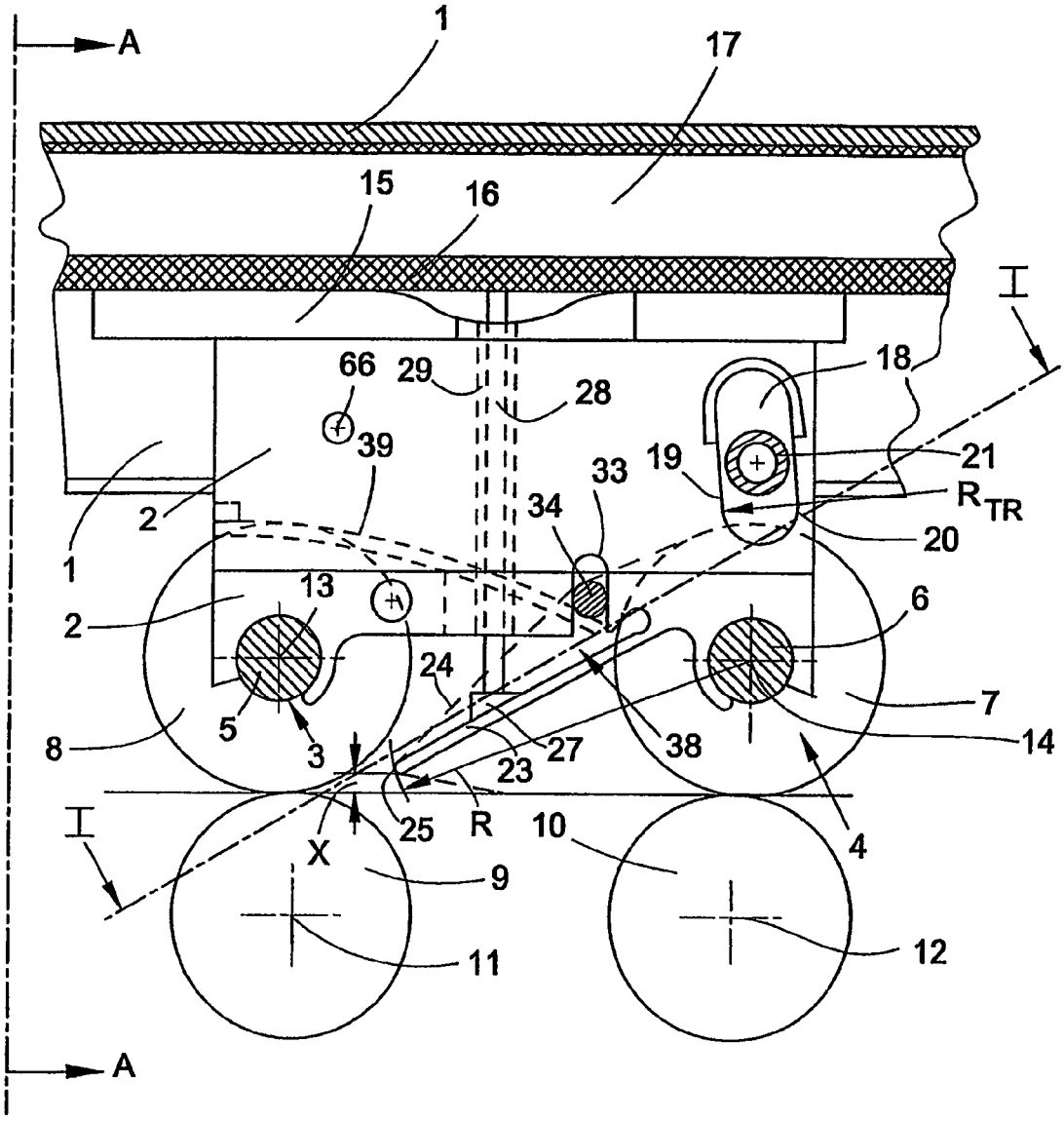
FIG. 1 shows a simplified partial view of a top roller carrier with a holding device in a side view, partially in section.

FIG. 1, shows a part of a top roller carrier 1, which carries a holding device 2. Top roller carriers of this type are used on drafting systems of spinning machines. The holding device 2 has axle receivers 3, 4 for the axles 5, 6 of the pair of apron rollers and the pair of output rollers. The position of the pair of apron rollers and the pair of output rollers is indicated in each case by an apron roller 7 and an output roller 8. The two axle receivers 3, 4 are part of the one-piece holding device 2. The holding device 2 consists of the elastic plastics material POM. Because of the elasticity, the axles 5, 6 can be pressed in a simple manner into the axle receivers 3, 4 during assembly. The axles 5, 6 are reliably held in the snap-on connection. The pair of apron rollers and the pair of output rollers together with the pair of feed rollers, not shown in FIG. 1, form the top rollers of the drafting system. The associated bottom rollers 9, 10 are positioned in such a way that their rotational axes 11, 12 are offset with respect to the rotational axes 13, 14 of the output roller 8 and the apron roller 7. The rotational axis 11 of the bottom roller 9, in the view of FIG. 1, is not vertically beneath the rotational axis 13 of the output roller 8, but offset slightly to the right. The rotational axis 12 of the bottom roller 10, on the other hand, is offset slightly to the left with respect to the rotational axis 14 of the apron roller 7. If the apron roller 7 and the output roller 8 are loaded with pressure and pressed against the bottom rollers 9, 10, horizontal force components occur. The horizontal force component, which acts on the output roller 8 is directed to the left in the view of FIG. 1 and is called a forward biasing force. The horizontal force component, which acts on the apron roller 7 is directed to the right in the view of FIG. 1 and is called a rearward biasing force. The forward biasing force and rearward biasing force are substantially the same in the embodiment shown in FIG. 1, so only a small or hardly any horizontal force component acts on the holding device 2. There is therefore an almost friction-free coupling of the holding device 2 movably connected to the top roller carrier 1 to the top roller carrier 1. A stable position of the apron roller 7 and the output roller 8 with respect to the bottom rollers 9, 10 is established.

The pressure loading of the apron roller 7 and the output roller 8 takes place pneumatically. A head part which is configured as a pressure plate 15 and on which the base plate 16 of an elastic hollow body 17 rests is arranged on the holding device 2. By loading the hollow body 17 with compressed air, the holding device 2 is pressed downwardly, the pressure is transferred to the apron roller 7 and the output roller 8 and the apron roller 7 and the output roller 8 are pressed on the bottom rollers 9, 10. The pressure plate 15 is displaceable in the longitudinal direction of the top roller carrier 1 relative to the holding device 2. If the pressure plate 15 in the view of FIG. 1 is displaced to the left, the pressure on the output roller 8 is increased, and the pressure on the apron roller 7 becomes less. If the pressure plate 15 is displaced to the right, the pressure on the output roller 8 reduces and the pressure on the apron roller 7 becomes greater. In this manner, the pressure distribution on the apron roller 7 and the output roller 8 can be designed so as to be variable.

The holding device 2 has an elongated hole 18, the edges 19, 20 of which in each case run on the radius $R_{TR}$, which is placed round the pivot point of the top roller carrier 1. A hollow bolt 21 is guided in the elongated hole 18 and is rigidly connected to the top roller carrier 1 by means of screws 22. Owing to the interaction of the elongated hole 18 and the hollow bolt 21, the holding device 2 can be positioned independently of the level which the top roller carrier 1 adopts. The metallic hollow bolt 21 reinforces the U-shaped, downwardly open body of the top roller carrier 1.

Figure 2:
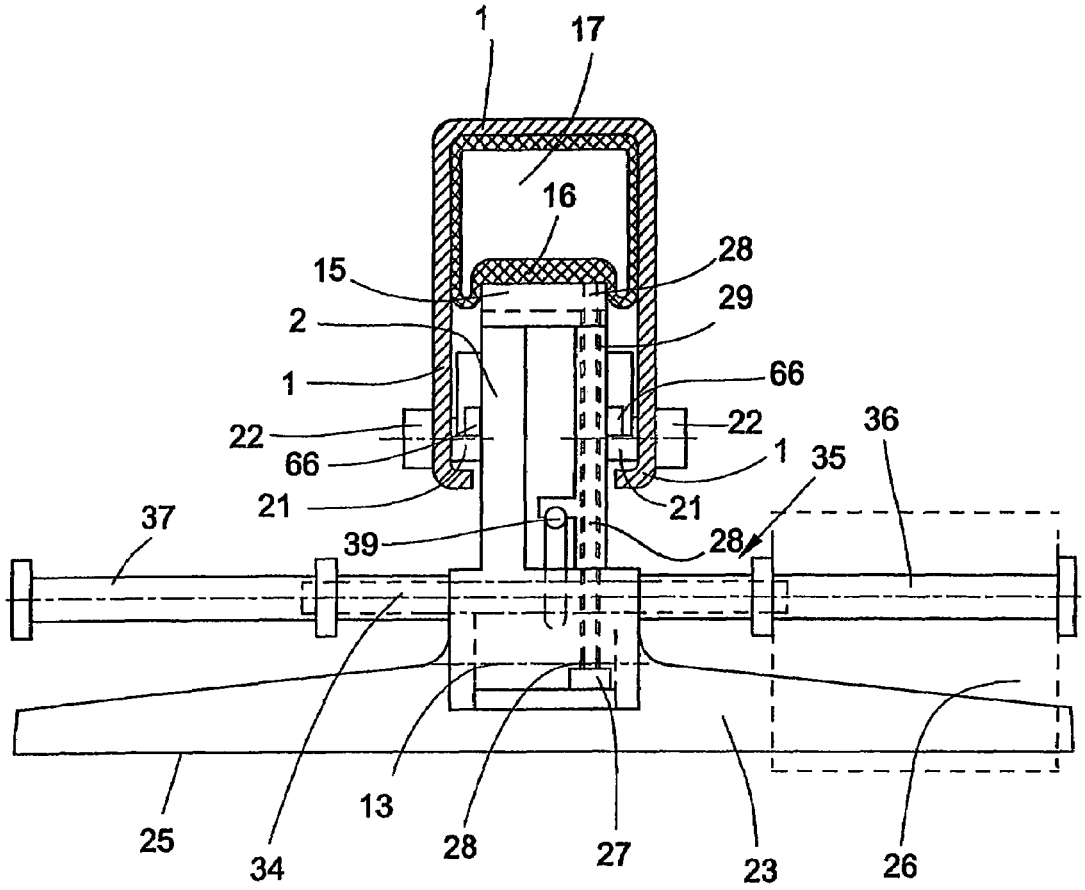
FIG. 2 shows the holding device of FIG. 1 in the view A-A, partially in section.

The holding device 2 has an top apron deflection device configured as a vane 23, via which the top apron 24 is guided, toward the axle receivers 3, 4. The free end of the vane 23 has a spacing R from the rotational axis 14 of the apron roller 7. The spacing R is, for example, 35 mm, in an embodiment for the processing of short-staple fibre material. The free end forms the deflection edge 25 for the two top aprons 24, 26 of the pair of apron rollers. The width of the vane 23 is matched to the greatest required spindle division. In the direction of action of the force, by means of which the top aprons 24, 26 are tensioned, the vane 23 is configured so as to be very stiff. In the vertical direction, the deflection edge 25 at the free edge of the vane 23 can be moved without a large exertion of force. Therefore, the degree of opening X can be easily adjusted for the opening widths required in each case. The form of the vane 23 can be seen in FIGS. 2 and 3. The position of the top apron 26 is shown in FIG. 2 by dashed lines. The vane 23 has a lug 27 on which a piston 28 applies a contact force. The contact force is transferred to the piston 28 from the base plate 16. The piston 18 is movably guided in a bore 29 of the holding device 2.

Figure 3:
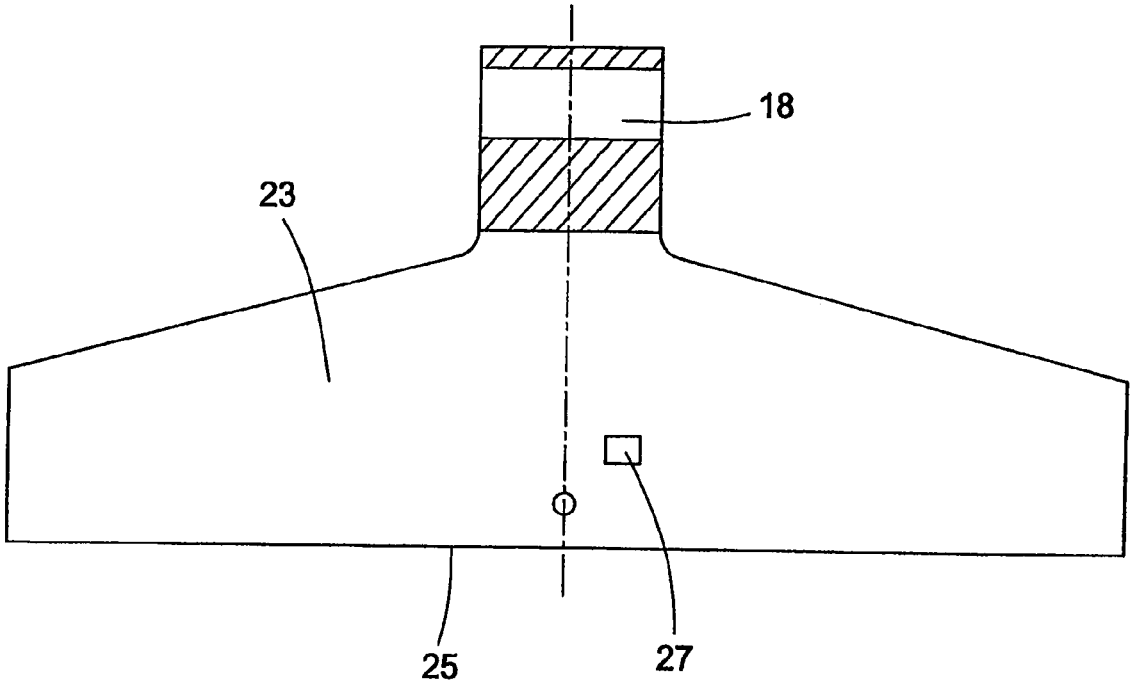
FIG. 3 shows a plan view of the top apron deflection device of the holding device of FIG. 1 in the view I-I, partially in section.
Figure 4:
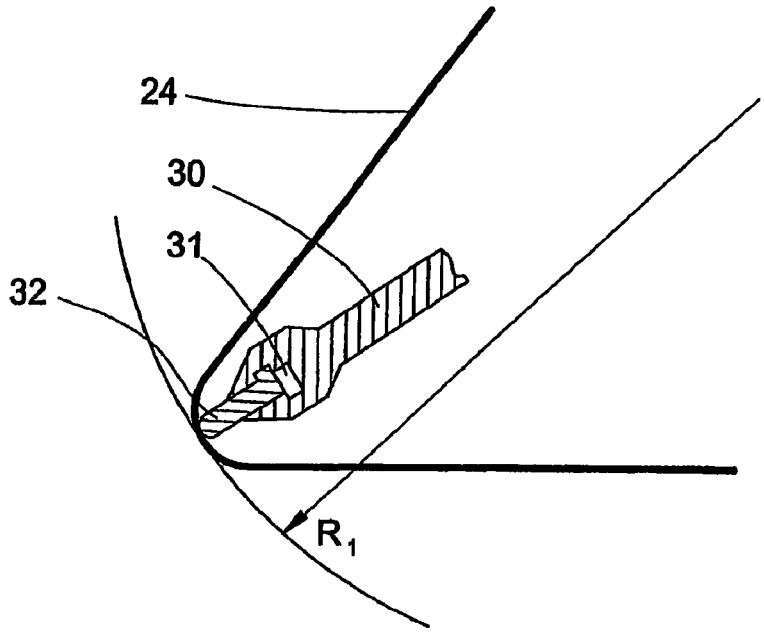
FIG. 4 shows the deflection edge of the top roller deflection device with metal bar, in a side view.
Figure 4A:
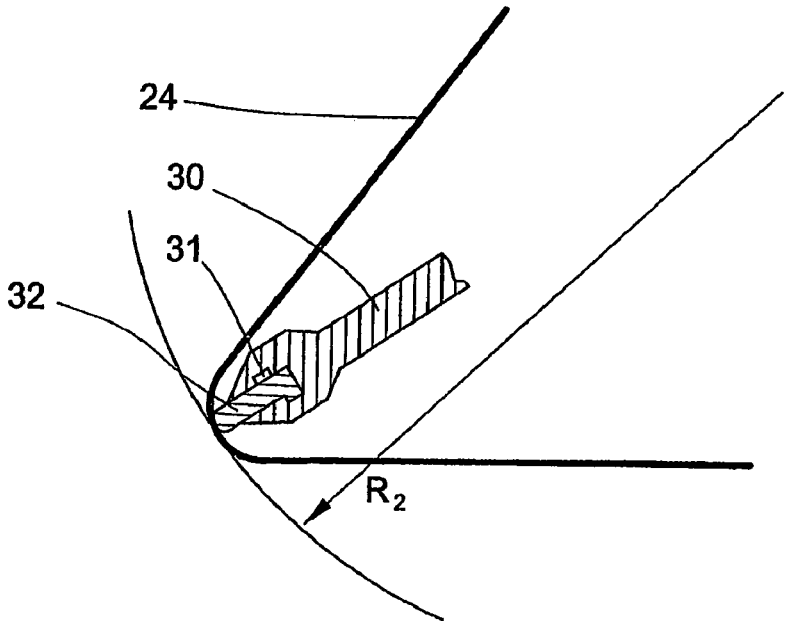
FIG. 4A shows a deflection edge of the top roller deflection device with the metal bar in an alternative position, in a side view.

FIG. 4 shows an alternative embodiment to the vane 23 shown in FIGS. 1 to 3. The vane 30 has a receiver 31 for a chromium-plated replaceable metal bar 32. The receiver 31 is configured in such a way that the metal bar 32 can be positioned alternatively in two different positions. FIG. 4 shows a first position of the metal bar 32 in which the spacing $R_1$ from the rotational axis 14 of the apron roller 7 is produced. FIG. 4A shows a second position of the metal bar 32, in which the spacing R2 is produced. The spacing R2 is smaller than the spacing $R_1$. Because it is possible to replace the metal bar 32, the position of the deflection edge 25 can be adapted by a suitable selection of the metal bar 32 and/or by the selection of the position of the metal bar 32 to the respective production conditions in such a way that an optimum spinning geometry is ensured. The position of the deflection edge 25 can be selected such that an adequate spacing is ensured between the output roller 8 and top apron 24. A quality-impairing brushing of the top apron 24 on the output roller 8 is reliably avoided. The chromium-plated metal bar 32 is particularly resistant to wear and brings about low-friction deflection of the top aprons 24, 26. The apron slippage and the wear of the top aprons 24, 26 is reduced.

The holding device 2 has a vertically oriented and downwardly open slot 33 between the vane 23 and the axle receiver 3. The slot 33 is used as a guide link for the carrier axle 34 of an apron tensioner 35. A guide element 36, 37 is fastened, in each case, as shown in FIG. 2, on either side on the carrier axle 34. The guide elements 36, 37 hold the top aprons 24, 26 in the desired position and prevent their axial displacement. The gap 38 between the vane 23 and the lower side of the holding device 2 is slightly smaller than the diameter of the carrier axle 34. When installing the carrier axle 34, the vane 23 is deflected because of its elasticity and the carrier axle 34 can easily be pressed into the slot 33. The carrier axle 34 is prevented in this manner from falling out of the holding device 2.

A spring element 39 presses from below against the carrier axle 34. The top aprons 24, 26 are tensioned by means of the carrier axle 34 with a selectable force. The position of the tensioned top apron 26 is shown by dashed lines in the view of FIG. 2. The top apron 24 adopts a corresponding mirror-inverted position on the left-hand side of the holding device 2, but is not shown in FIG. 2. The top rollers and the bottom rollers together with axles are also not shown in FIG. 2.

The holding device 2, on each side, has a knob 66, with which the holding device 2 is secured in the top roller carrier 1.

Figure 5:
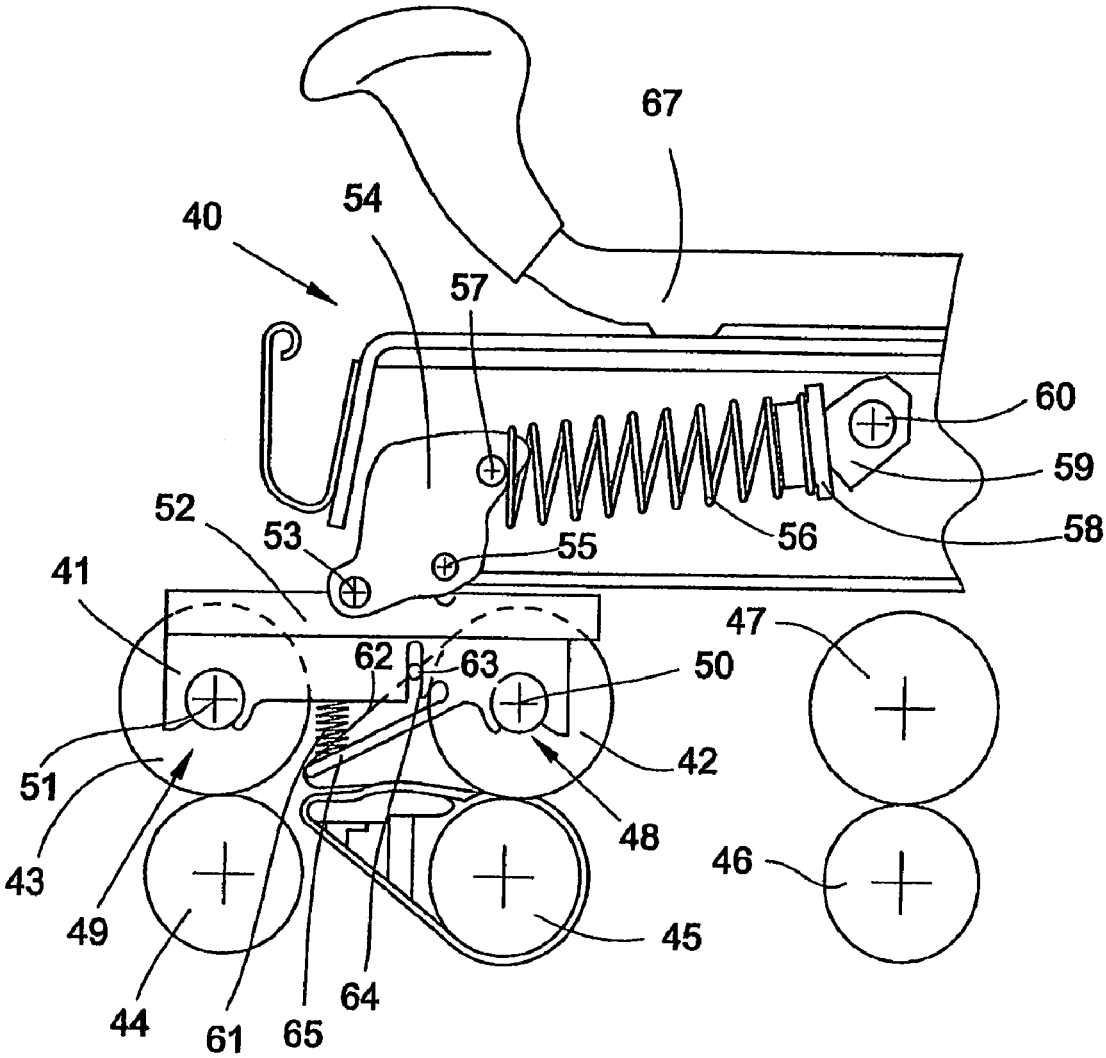
FIG. 5 shows a simplified partial view of a top roller carrier with a spring-loaded holding device in a side view, partially in section.

FIG. 5 shows a top roller carrier 40 with a holding device 41, which is loaded by means of a spring force in order to generate the force, required for the spinning process, of the apron roller 42 and the output roller 43 on the bottom rollers 44, 45. The bearings of the bottom rollers 44, 45, 46 and the top rollers configured as feed rollers 47 are not shown in FIG. 5 for reasons of simplification. The axle receiver 48 configured as a snap-on connection holds the axle 50 of the apron roller 42. The axle receiver 49 holds the axle 51 of the output roller 43. The forward biasing force of the output roller 43 and the rearward biasing force of the apron roller 42 substantially balance each other out in the embodiment of FIG. 5, so only a slight or even no horizontal force component acts on the holding device 41, as is also the case in the holding device 2 shown in FIG. 1. A head part configured as a pressure plate 52 is arranged on the holding device 41. The pressure plate 52 consists of steel. The pressure plate 52 is suitable both for holding devices for processing short-staple fibre material and for holding devices, which are to be used for processing medium-staple or long-staple fibre material.

The holding devices can be replaced simply and rapidly. The pressure plate 52 and the holding device 41 fastened to it are pivotally connected to a pressure plate 54 by means of a snap-on connection and a bolt 53. The pressure plate 54 can be pivoted about a pivot axle 55 rigidly connected to the top roller carrier 40. The compression spring 56 is supported, on the one hand, on a transverse pin 57 of the pressure plate 54 and, on the other hand, on a support disc 58. The support disc 58 rests on an eccentric element 59. The eccentric element 59 is rotatably mounted on a pivot axle 60. The pivot axle 60 is rigidly connected to the top roller carrier 40. By rotating the eccentric element 59, the force can be adjusted, with which the compression spring 56 loads the pressure plate 54 and therefore, via the holding device 41, the apron roller 42 and the output roller 43. The pressure plate 54 is configured such that the holding device 40 is loaded with a substantially constant force, even if the height position of the top roller carrier 40 is adjusted within a specific range. This range may be about 6 mm. A compression spring 61 loads the vane 65 with a specific force directed downwardly. The vane 65 is used to deflect the top apron 62 of the apron roller 42 and the other top apron and the associated other apron roller, neither of which are shown in FIG. 5, and which in each case form a pair with the top apron 62 and the apron roller 42. An apron tensioner 63, as shown in FIG. 1, 2 or 4, is used to tension the top apron 62 and the top apron arranged in a mirror-inverted manner with respect thereto. The apron tensioner 63 can be moved up and down in the slot 64 and is pressed upwardly by a spring element, not shown.

The operating position of the top roller carrier 40 shown in FIG. 5 is secured by means of the lever 67.

The holding devices, configured in each case for the processing of short-staple, medium-staple or long-staple fibre material, can be replaced easily and simply.

The apron guides can be configured to rotate in a smooth-running manner, so the apron slippage can be further reduced.

In the scope of the invention, further embodiments of top roller carriers are possible. For example, instead of the vanes 23, 30, 65 shown in the figures, which form a one-piece part with the holding device 2, 41, a vane can be used, which is configured as a separate part and fastened to the holding device 2, 41.

The invention claimed is:

1. Top roller carrier for drafting systems in spinning machines with at least one pair of feed rollers, one pair of apron rollers and one pair of output rollers as top rollers and with holding devices for the top rollers, wherein the top rollers are rotatably mounted on the ends of axles and the axles are held centrally, in each case, between the top rollers, wherein a common holding device (2, 41) is provided for the axle (5, 51) of the output rollers (8, 43) and the axle (6, 50) of the apron rollers (7, 42) and is movably connected to the top roller carrier (1, 40), characterized in that the holding device (2, 41) with the axle receivers (3, 4, 48, 49) for the axles (5, 6, 50, 51) of the output rollers (8, 43) and of the apron rollers (7, 42) comprises a one-piece component made of plastics material, so that the axle receivers (3, 4, 48, 49) are arranged at a rigid spacing with respect to one another, and in that a top apron deflection device is part of the one-piece component.

2. Top roller carrier according to claim 1, characterized in that the top apron deflection device is configured as a vane (23, 30, 65) and ends at the free end with a deflection edge (25).

3. Top roller carrier according to claim 1,characterized in that the top apron deflection device is configured as a vane (30), on the free end of which a chromium-plated replaceable metal bar (32) is fastened for the deflection of top aprons (24, 26) and wherein the metal bar (32) can alternatively be positioned in at least two positions.

4. Top roller carrier according to claim 1, characterized in that the holding device (2, 41) has a slot (33, 64) being used as a guid link, in which slot a rotationally symmetrically shaped apron tensioner (35, 63) is guided, which is oriented axially parallel to the top rollers (7, 8, 42, 43, 47) and can be moved relative to the holding device (2, 41) under the action of tension.

5. Top roller carrier according to claim 1, characterized in that the plastics material is polyoxymethylene.

6. Top roller carrier according to claim 5, characterized in that the plastics material is electrically conductive.

7. Top roller carrier according to claim 1, characterized in that the spacing between the apron roller (7, 42) and the feed roller (47) can be adjusted.

8. Top roller carrier according to claim 1, characterized in that the axle receivers (3, 4, 48, 49) are configured as an elastic snap-on connection.

* * * * *